US011491078B1

(12) United States Patent
He

(10) Patent No.: US 11,491,078 B1
(45) Date of Patent: Nov. 8, 2022

(54) FINGER SWINGING MASSAGE DEVICE

(71) Applicant: Shenzhen S-Hande Technology Co., Ltd., Shenzhen (CN)

(72) Inventor: Jing He, Shenzhen (CN)

(73) Assignee: SHENZHEN S-HANDE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/717,138

(22) Filed: Apr. 11, 2022

(51) Int. Cl.
*A61H 23/02* (2006.01)
*A61H 7/00* (2006.01)

(52) U.S. Cl.
CPC ..... *A61H 23/0263* (2013.01); *A61H 7/005* (2013.01); *A61H 2201/1215* (2013.01); *A61H 2201/149* (2013.01); *A61H 2201/1463* (2013.01); *A61H 2201/1669* (2013.01)

(58) Field of Classification Search
CPC .... A61H 2201/1215; A61H 2201/1463; A61H 2201/149; A61H 2201/1669; A61H 2201/12–1246; A61H 19/00; A61H 19/32; A61H 23/00; A61H 23/02
See application file for complete search history.

(56) References Cited

U.S. PATENT DOCUMENTS

2015/0148592 A1* 5/2015 Kanbar ..... A61H 19/34 600/38
2020/0046598 A1* 2/2020 Shen ..... A61H 1/00
2020/0094930 A1* 3/2020 Chen ..... B63C 11/205
2022/0096320 A1* 3/2022 Lu ..... A61H 23/006

FOREIGN PATENT DOCUMENTS

CN 108743300 A * 11/2018

* cited by examiner

*Primary Examiner* — Justine R Yu
*Assistant Examiner* — Matthew R Moon

(57) ABSTRACT

A finger swinging massage device includes a hard inner housing, a soft outer housing surrounding the hard inner housing, and at least one swinging member installed between the hard inner housing and the soft outer housing. The at least one swinging member includes a rotary motor, an eccentric wheel connected with the rotary motor in transmission, a limiting sleeve fixed on the hard inner housing, and a swinging rod, with two opposite sides of the swinging rod rotatably connecting with the limiting sleeve, and a lower end of the swinging rod connecting with the eccentric wheel in transmission. The eccentric wheel cooperates with the limiting sleeve to convert rotation of the rotary motor into to-and-fro movement of the swinging rod, the swinging rod is exposed on a top portion of the hard inner housing, and the soft outer housing includes a massage portion corresponding to connect with the swinging rod.

10 Claims, 3 Drawing Sheets

FINGER SWINGING MASSAGE DEVICE

BACKGROUND

1. Technical Field

The present disclosure generally relates to the field of massage devices, and especially relates to a finger swinging massage device.

2. Description of Related Art

Nowadays pace of life is faster and faster, and a time for leisure and exercise is greatly squeezed so that more and more people choose massage devices for leisure and relaxation. A conventional portable massage device is compact and easy to be operated, however, a massage mode of the conventional portable massage device is usually single, which brings limited massage experiences to users. Therefore, such conventional massage device needs to be improved.

SUMMARY

The technical problems to be solved: in view of the shortcomings of the related art, the present disclosure provides an improved finger swinging massage device.

The technical solution adopted for solving technical problems of the present disclosure is:

a finger swinging massage device includes a hard inner housing, a soft outer housing surrounding the hard inner housing, and at least one swinging member installed between the hard inner housing and the soft outer housing; the at least one swinging member including a rotary motor, an eccentric wheel connected with the rotary motor in transmission, a limiting sleeve fixed on the hard inner housing, and a swinging rod, with two opposite sides of the swinging rod rotatably connecting with the limiting sleeve, and a lower end of the swinging rod connecting with the eccentric wheel in transmission; and wherein the eccentric wheel cooperates with the limiting sleeve to convert rotation of the rotary motor into to-and-fro movement of the swinging rod, the swinging rod exposed on a top portion of the hard inner housing, and the soft outer housing comprising a massage portion corresponding to connect with the swinging rod.

Wherein the hard inner housing includes an opening for the swinging rod to pass therethrough, the limiting sleeve with a hollow structure embedded at the opening and sleeved outside the rotary motor, a pair of posts formed on an upper end of the limiting sleeve and opposite to each other, and the two opposite sides of the swinging rod rotatably connected with the pair of posts, respectively.

Wherein a pair of flanges is arranged on the periphery of the limiting sleeve and arranged at intervals from top to bottom to form a clamping slot therebetween, and the clamping slot clamped on an edge of the opening.

Wherein the hard inner housing further includes a clamping block surrounding the opening, and abutted against the periphery of the limiting sleeve.

Wherein a pair of opposite notches is formed on the upper end of the limiting sleeve and connected to each other to form a sliding channel therebetween so that a lower end of the swinging rod slides in the sliding channel.

Wherein a limiting block is formed on an inner wall of the limiting sleeve, and abutted against an upper surface of the rotary motor.

Wherein the massage device further includes a vibrating motor received in the swinging rod.

Wherein the massaging portion is a finger-shape configuration.

Wherein the massage portion is a finger-shape configuration.

Wherein the swinging rod includes a rotating pin rotatably connected with the limiting sleeve, and a nozzle structure located at an end of the swinging rod near the rotating pin, and an opposite end of the swinging rod away from the rotating pin sleeved with the massage portion; and the nozzle structure including a first portion and a second portion opposite to the first portion, and a receiving chamber formed between the first and second portions; and wherein the eccentric wheel extends into the receiving cavity and contacts with the first and second portions back and forth during rotating the eccentric wheel, and the nozzle structure moves linearly back and forth, so that the swinging rod swings around the rotating pin.

Wherein the hard inner housing is made of plastic material, and the soft outer housing is made of silica gel material.

Wherein the eccentric wheel includes a first shaft connected with the rotary motor, and a second shaft eccentrically arranged on the first shaft and extending into the receiving cavity of the nozzle structure.

Wherein both a control circuit board and a battery are received in the hard inner housing, both the rotary motor and the battery electrically connected with the control circuit board, respectively; the control circuit board configured to control an action of the rotary motor, and the battery equipped with a magnetic-suction charging terminal to supply power in time and maintain an endurance capacity.

The present disclosure provides the advantages as below.

The finger swinging massage device of the present disclosure converts the rotation of the rotary motor into the to-and-fro movement of the swinging rod through providing the eccentric wheel and the limiting sleeve, so as to drive the massage portion arranged on the swinging rod to swing left and right for massaging the human body, which has stable operation and reliable usage by imitating human fingers to improve massage comfort of users.

Figure 1:
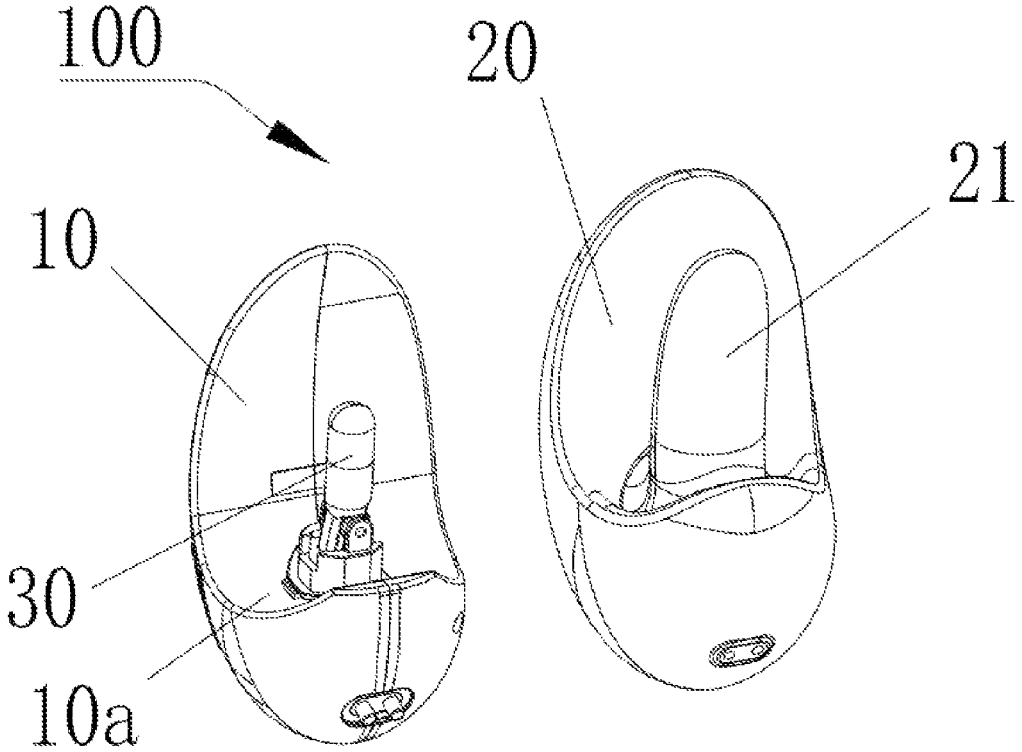
FIG. 1 is an exploded, schematic view of a finger swinging massage device in accordance with an embodiment of the present disclosure.
Figure 2:
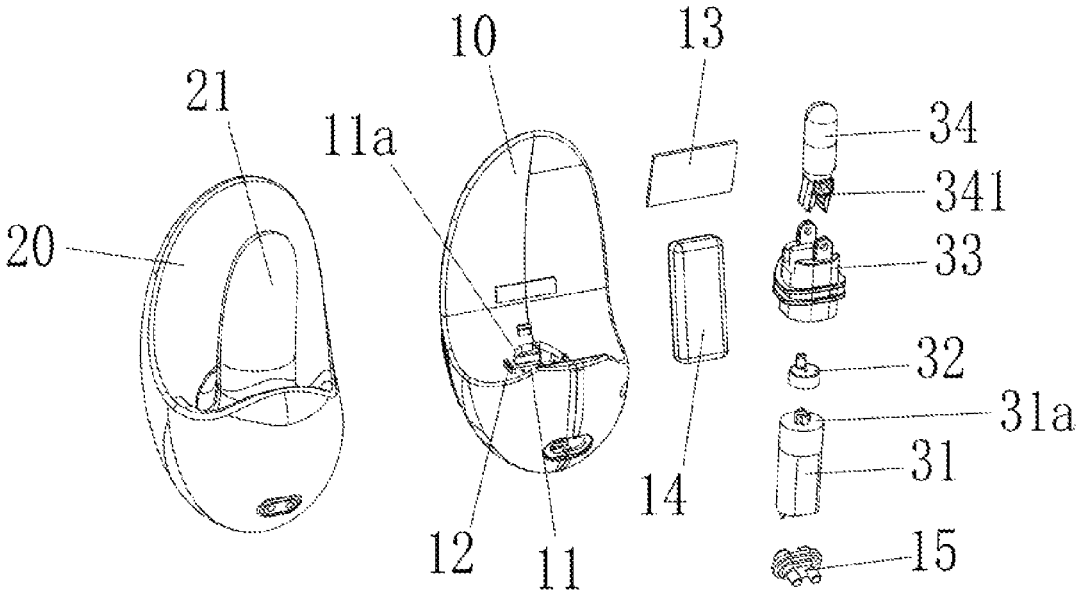
FIG. 2 is a further exploded, schematic view of the finger swinging massage device of FIG. 1.

The element labels according to the exemplary embodiment of the present disclosure shown as below:

100 finger swinging massage device, 10 hard inner housing, 10*a* top portion, 11 opening, 11*a* edge, 12 clamping block, 13 control circuit board, 14 battery, 15 magnetic-suction charging terminal, 20 soft outer housing, 21 massage portion, 30 swinging member, 31 rotary motor, 31*a* upper surface, 32 eccentric wheel, 321 first shaft, 322 second shaft, 33 limiting sleeve, 33*a* upper end, 33*b* inner wall, 331 post, 332 flange, 333 clamping slot, 334 notch, 335 sliding channel, 336 limiting block,

34 swinging rod, 34*a* opposite sides, 34*b* lower end, 341 rotating pin, 342 nozzle structure, 343 first portion, 344 second portion, 345 receiving chamber, 35 vibrating motor.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described embodiment of the present disclosure, all other embodiments obtained by one of ordinary skill in the related art on the premise of no creative work are within the protection scope of the present disclosure.

In the description of the present disclosure, it needs to be explained that all the directional indicators (such as the terms: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In the description of the present disclosure, except where specifically otherwise illustrated or limited, the terms "connect" and "link" used herein should be understood in a broad sense. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIGS. 1-5, a finger swinging massage device 100 in accordance with an embodiment of the present disclosure includes a hard inner housing 10, a soft outer housing 20 surrounding the hard inner housing 10, and at least one swinging member 30 installed between the hard inner housing 10 and the soft outer housing 20.

In an embodiment of the present disclosure, the hard inner housing 10 is made of plastic material, which is hardness and difficult to deform, and has a certain anti-collision protection ability to protect components received in the hard inner housing 10 from being damaged. The soft outer housing 20 is made of silica gel material, which is relatively soft, has advantages of good elasticity and good hand feeling, without harming skins of users, so as to feel more comfortable during in contact with skins of users.

The at least one swinging member 30 includes a rotary motor 31, an eccentric wheel 32 connected with the rotary motor 31 in transmission, a limiting sleeve 33 fixed on the hard inner housing 10, and a swinging rod 34. Two opposite sides 34*a* of the swinging rod 34 are rotatably connecting with the limiting sleeve 33, respectively, and a lower end 34*b* of the swinging rod 34 connects with the eccentric wheel 32 in transmission. The limiting sleeve 33 is provided for fixing the swinging rod 34. The eccentric wheel 32 cooperates with the limiting sleeve 33 to convert rotation of the rotary motor 31 into to-and-fro movement of the swinging rod 34, which has stable operation and reliable usage.

Specifically, both a control circuit board 13 and a battery 14 are received in the hard inner housing 10, both the rotary motor 31 and the battery 14 are electrically connected with the control circuit board 13, respectively. The control circuit board 13 is configured to control an action of the rotary motor 31, and the battery 14 is equipped with a magnetic-suction charging terminal 15 to supply power in time and maintain an endurance capacity.

The swinging rod 34 is exposed on a top portion 10*a* of the hard inner housing 10, and the soft outer housing 20 includes a massage portion 21 corresponding to connect with the swinging rod 34. Preferably, the massage portion 21 is a finger-shape configuration.

During using the massage device 100, the rotary motor 31 rotates, and the eccentric wheel 32 cooperates with the limiting sleeve 33 to convert rotation of the rotary motor 31 into to-and-fro movement of the swinging rod 34, so as to drive the massage portion 21 of the swinging rod 34 to swing left and right to massage bodies of users, which can imitate human fingers to improve massage comfort of users.

Of course, in other embodiments of the present disclosure, a plurality of swing members 30 can be set, and the number of massage portions 21 of the soft outer housing 20 is set corresponding to the number of swinging rods 34 of the swing member 30. In this way, a plurality of massage portions 21 can be used to massage the human body at the same time to further improve the massage effect.

In some embodiments of the present disclosure, the hard inner housing 10 includes an opening 11 for the swinging rod 34 to pass therethrough, the limiting sleeve 33 with a hollow structure embedded at the opening 11 and sleeved outside the rotary motor 31. Specifically, a pair of flanges 332 is arranged on the periphery of the limiting sleeve 33 and arranged at intervals from top to bottom to form a clamping slot 333 therebetween, and the clamping slot 333 clamped on an edge of the opening 11, to prevent the limiting sleeve 33 from falling out of the hard inner housing 10 under a condition of up and down movement, which is a simple structure and convenient for installation and disassembly the massage device 100.

The limiting sleeve 33 is a hollow structure, a pair of posts 331 is formed on an upper end 33*a* of the limiting sleeve 33 and opposite to each other, and two opposite sides 34*a* of the swinging rod 34 rotatably connected with the pair of posts 331, respectively, which has good structural stability. Specifically, a pair of opposite notches 334 is formed on the upper end 33*a* of the limiting sleeve 33 and connected to each other to form a sliding channel 335 therebetween so that a lower end 34*b* of the swinging rod 34 slides left and right in the sliding channel 335. In this way, a sliding track of the massage portion 21 is formed to play the role of guidance and limitation.

In some embodiments of the present disclosure, the hard inner housing 10 further includes a clamping block 12 surrounding the opening 11, and abutted against the periphery of the limiting sleeve 33, to prevent the limiting sleeve 33 from shaking left and right and improve stability therebetween.

In some embodiments of the present disclosure, a limiting block 336 is formed on an inner wall 33*b* of the limiting sleeve 33, and abutted against an upper surface 31*a* of the rotary motor 31, to prevent the rotary motor 31 from falling out of the hard inner housing 10.

Figure 3:
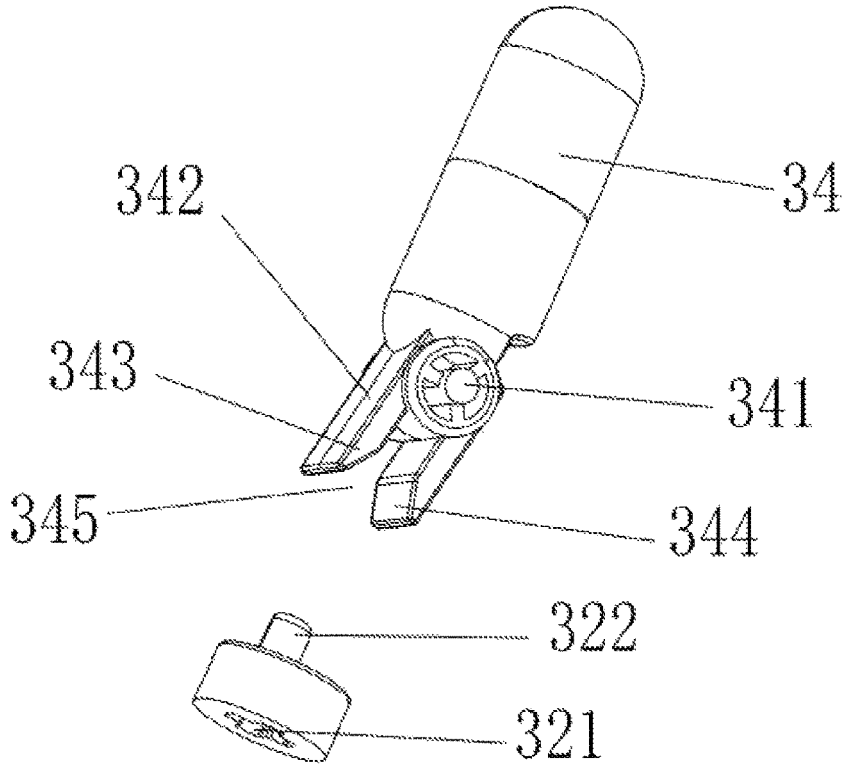
FIG. 3 is a schematic view of an eccentric wheel and a swinging rod of the finger swinging massage device of FIG. 1.
Figure 4:
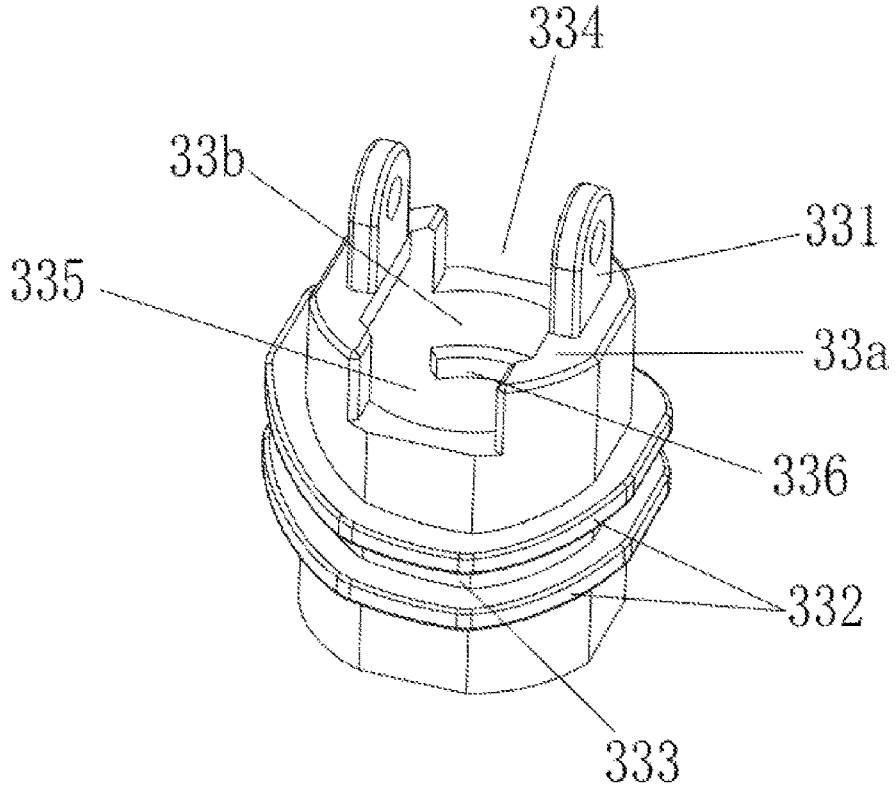
FIG. 4 is a schematic view of the limiting sleeve of the finger swinging massage device of FIG. 3.
Figure 5:
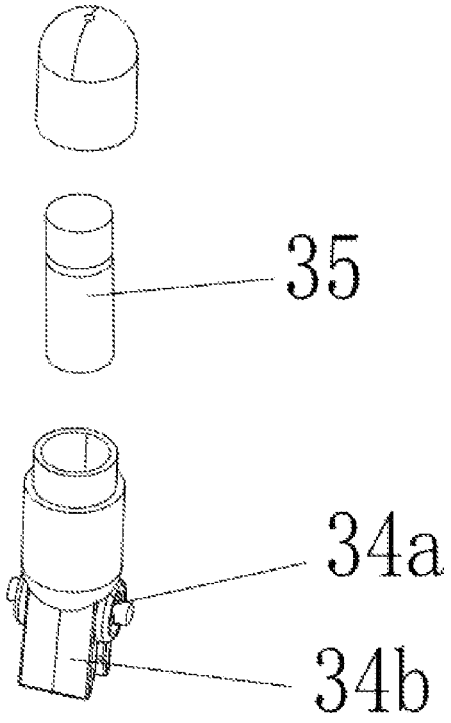
FIG. 5 is an exploded, schematic view of the swinging rod of the finger swinging massage device of FIG. 3.

In an embodiment of the present disclosure, referring to FIG. 3, the swinging rod 34 includes a rotating pin 341 rotatably connected with the limiting sleeve 33, and a nozzle structure 342 located at an end of the swinging rod 34 near the rotating pin 341, and an opposite end of the swinging rod 34 away from the rotating pin 341 sleeved with the massage portion 21; and the nozzle structure 342 including a first portion 343 and a second portion 344 opposite to the first portion 343, and a receiving chamber 345 formed between the first and second portions 343, 344; and wherein the eccentric wheel 32 extends into the receiving cavity 345 and contacts with the first and second portions 343, 344 back and forth during rotating the eccentric wheel 32, and the nozzle structure 342 moves linearly back and forth, so that the swinging rod 34 swings around the rotating pin 341.

A part of the eccentric wheel 32 extending into the receiving cavity 345 is movable rather than being fixed in the receiving cavity 345. The part contacts the first portion 343 and the second portion 344 back and forth during rotation, so as to drive the linear left and right reciprocating movement of the nozzle structure 342, and then, due to the action of the rotating pin 341, the linear movement of the nozzle structure 342 drives the swinging rod 34 to swing.

Furthermore, the eccentric wheel 32 includes a first shaft 321 and a second shaft 322 eccentrically arranged on the first shaft 321. The first shaft 321 is connected with the rotary motor 31, and the second shaft 322 extends into the receiving cavity 345 of the nozzle structure 342.

The rotary motor 31 rotates to drive the first shaft 321 to rotate, and then the first shaft 321 drives the second shaft 322 to rotate. Because the part of the second shaft 322 extending into the receiving cavity 345 is movable, when the second shaft 322 rotates, the part of the second shaft 322 extending into the receiving cavity 345 will repeatedly contact the first portion 343 and the second portion 344. For example, when the second shaft 322 rotates in an upper half circle, the part of the second shaft 322 extending into the receiving cavity 345 contacts the first portion 343 to push the first portion 343 from a middle position to the leftmost position, so as to complete a left swing of the swinging rod 34; when the second shaft 322 rotates in a lower half circle, the part of the second shaft 322 extending into the receiving cavity 345 contacts the second portion 344 to push the second portion 344 from the middle position to the rightmost position, so as to complete a right swing of the swinging rod 34. In this way, such a cycle completes the reciprocating swing of the swinging rod 34, so that the massage portion 21 on the swinging rod 34 follows the reciprocating swing.

In some embodiments of the present disclosure, the massage device 100 further includes a vibrating motor 35 received in the swinging rod 34. The vibration motor 35 vibrates to drive the massage portion 21 to follow vibrating. The massage portion 21 can swing or vibrate, either alone or at the same time, so as to achieve double stimulation effect and further improve use experience of users.

The specific embodiments of the present disclosure are described in detail above in combination with the accompanying drawings, but not limited to the above embodiments. Various changes can also be made within the knowledge of an ordinary skilled person in the art without departing from the purpose of the present disclosure, each feature or element can be used alone or in other various combinations within the principles of the present disclosure to the full extent indicated by the broad general meaning of the terms in which the appended claims are expressed.

What is claimed is:

1. A finger swinging massage device comprising a hard inner housing, a soft outer housing surrounding the hard inner housing, and at least one swinging member installed between the hard inner housing and the soft outer housing; the at least one swinging member comprising a rotary motor, an eccentric wheel connected with the rotary motor in transmission, a limiting sleeve fixed on the hard inner housing, and a swinging rod, with two opposite sides of the swinging rod rotatably connecting with the limiting sleeve, and a lower end of the swinging rod connecting with the eccentric wheel in transmission; and wherein the eccentric wheel cooperates with the limiting sleeve to convert rotation of the rotary motor into to-and-fro movement of the swinging rod, the swinging rod exposed on a top portion of the hard inner housing, and the soft outer housing comprising a massage portion corresponding to connect with the swinging rod; and wherein the hard inner housing comprises an opening for the swinging rod to pass therethrough, the limiting sleeve with a hollow structure embedded at the opening and sleeved outside the rotary motor, a pair of posts formed on an upper end of the limiting sleeve and opposite to each other, and the two opposite sides of the swinging rod rotatably connected with the pair of posts, respectively; and wherein a pair of flanges is arranged on the periphery of the limiting sleeve and arranged at intervals from top to bottom to form a clamping slot therebetween, and the clamping slot clamped on an edge of the opening.

2. The finger swinging massage device as claimed in claim 1, wherein the hard inner housing further comprises a clamping block surrounding the opening, and abutted against the periphery of the limiting sleeve.

3. The finger swinging massage device as claimed in claim 1, wherein a pair of opposite notches is formed on the upper end of the limiting sleeve and connected to each other to form a sliding channel therebetween so that a lower end of the swinging rod slides in the sliding channel.

4. The finger swinging massage device as claimed in claim 1, wherein a limiting block is formed on an inner wall of the limiting sleeve, and abutted against an upper surface of the rotary motor.

5. The finger swinging massage device as claimed in claim 1, wherein the massage device further comprises a vibrating motor received in the swinging rod.

6. The finger swinging massage device as claimed in claim 1, wherein the massage portion is a finger-shape configuration.

7. The finger swinging massage device as claimed in claim 1, wherein the swinging rod comprises a rotating pin rotatably connected with the limiting sleeve, and a nozzle structure located at an end of the swinging rod near the rotating pin, and an opposite end of the swinging rod away from the rotating pin sleeved with the massage portion; and the nozzle structure comprising a first portion and a second portion opposite to the first portion, and a receiving chamber formed between the first and second portions; and wherein the eccentric wheel extends into the receiving cavity and contacts with the first and second portions back and forth during rotating the eccentric wheel, and the nozzle structure moves linearly back and forth, so that the swinging rod swings around the rotating pin.

8. The finger swinging massage device as claimed in claim 7, wherein the eccentric wheel includes a first shaft connected with the rotary motor, and a second shaft eccentrically arranged on the first shaft and extending into the receiving cavity of the nozzle structure.

9. The finger swinging massage device as claimed in claim 8, wherein both a control circuit board and a battery are received in the hard inner housing, both the rotary motor and the battery electrically connected with the control circuit board, respectively; the control circuit board configured to control an action of the rotary motor, and the battery equipped with a magnetic-suction charging terminal to supply power in time and maintain an endurance capacity.

10. The finger swinging massage device as claimed in claim 1, wherein the hard inner housing is made of plastic material, and the soft outer housing is made of silica gel material.

* * * * *